US007905626B2

(12) United States Patent
Shantha et al.

(10) Patent No.: US 7,905,626 B2
(45) Date of Patent: Mar. 15, 2011

(54) MODULAR LIGHTING APPARATUS

(76) Inventors: Totada R. Shantha, McDonough, GA (US); Shaam P. Sundhar, Princeton, NJ (US)

( * ) Notice: Subject to any disclaimer, the term of this patent is extended or adjusted under 35 U.S.C. 154(b) by 166 days.

(21) Appl. No.: 12/193,304

(22) Filed: Aug. 18, 2008

(65) Prior Publication Data

US 2009/0045715 A1 Feb. 19, 2009

Related U.S. Application Data

(60) Provisional application No. 61/003,675, filed on Nov. 19, 2007, provisional application No. 61/003,702, filed on Nov. 19, 2007, provisional application No. 60/965,027, filed on Aug. 16, 2007.

(51) Int. Cl.
*H01R 33/06* (2006.01)

(52) U.S. Cl. ..... 362/228; 362/650; 362/651

(58) Field of Classification Search ..... 362/221, 362/228, 249.02, 650, 651
See application file for complete search history.

(56) References Cited

U.S. PATENT DOCUMENTS

| | | | | |
|---|---|---|---|---|
| 3,446,954 | A * | 5/1969 | Spiteri | 362/650 |
| 4,748,380 | A | 5/1988 | MacDonald et al. | |
| 5,341,068 | A | 8/1994 | Nerone | |
| 5,568,018 | A | 10/1996 | Muzic | |
| 5,653,527 | A * | 8/1997 | Muessli | 362/650 |
| 5,823,026 | A | 10/1998 | Finke | |
| 6,220,722 | B1 * | 4/2001 | Begemann | 362/231 |
| 6,390,646 | B1 | 5/2002 | Yan | |
| D461,260 | S | 8/2002 | Sundhar | |
| 6,488,386 | B1 | 12/2002 | Yan | |
| 6,488,388 | B2 | 12/2002 | Jones | |
| 6,879,117 | B2 | 4/2005 | Moon | |
| 6,891,339 | B2 | 5/2005 | Ribarich et al. | |
| 6,911,788 | B2 | 6/2005 | Moon | |
| 7,202,614 | B2 | 4/2007 | Bayat et al. | |
| 7,332,873 | B2 | 2/2008 | Newton | |
| 2002/0075676 | A1 * | 6/2002 | Jones | 362/226 |
| 2005/0281030 | A1 | 12/2005 | Leong et al. | |
| 2006/0044842 | A1 * | 3/2006 | Pazula | 362/655 |
| 2006/0146527 | A1 | 7/2006 | VanderSchuit | |

OTHER PUBLICATIONS

Samuel M. Goldwasster, et al; Compact Fluorescent Lamps; 1996, 1999; 3 pages; printed from the Internet www.members.misty.com.
Wikipedia; Compact Fluorescent Lamp; date unknown; 15 pages; printed from the Internet; www.widipedia.org.
Philips; Base Compact Fluorescent Light Bulb; 2 pages; date unknown; printed from the Internet www.1000bulbs.com.
Thorn Emi; Mazda Low Energy; 2 pages; date unknown; printed from the Internet www.lamptech.co.uk.

* cited by examiner

*Primary Examiner* — David V Bruce
(74) *Attorney, Agent, or Firm* — Gardner Groff Greenwald & Villanueva, PC

(57) ABSTRACT

A modular lighting apparatus includes a replaceable bulb assembly, an adapter, and a mechanical and electrical connector assembly that removably connects the bulb assembly to the adapter for use. The bulb assembly includes a light-emitting component mounted to a body. In example embodiments the light-emitting component includes spiral-tube CFLs, low-profile transverse CFL tubes, and omni-directional LED arrays. The adapter includes a standard screw base mounted to a body that houses an electronic ballast. In this way, the bulb assembly can be removed from the adapter and replaced, while reusing the electronic ballast in the adapter. And the screw-base adapter allows the reuse of the electronic ballast in standard screw-socket household light fixtures. In addition, the reusable adapter base also may be provided with an integral photocell for light-based control of the lighting apparatus without increasing the overall height of the composite lighting apparatus.

19 Claims, 7 Drawing Sheets

MODULAR LIGHTING APPARATUS

CROSS-REFERENCE TO RELATED APPLICATION

This application claims the priority benefit of the U.S. Provisional Patent Application Ser. No. 61/003,675, filed Nov. 19, 2007; U.S. Provisional Patent Application Ser. No. 61/003,702, filed Nov. 19, 2007; and U.S. Provisional Patent Application Ser. No. 60/965,027, filed Aug. 16, 2007, the entire scope and content of all of which is hereby incorporated herein by reference for all purposes.

FIELD OF THE INVENTION

The present invention relates generally to lighting apparatus and, in particular, to replaceable light bulbs for use in screw-socket light fixtures.

BACKGROUND OF THE INVENTION

Conventional screw-base incandescent bulbs remain the primary source of household electrical illumination. Compact fluorescent lamps (CFLs) with screw bases have been developed for household use, and they are much more efficient than incandescent bulbs. But CFLs currently account for only about 5 percent of the market for household electrical illumination bulbs, with all (or substantially all) of the remaining 95 percent being incandescent bulbs. One major reason that CFLs have not gained wider acceptance is that, relative to incandescent bulbs, they cost significantly more.

Accordingly, it can be seen that a need exists for improvements in CFLs to make them more affordable. It is to such solutions that the present invention is primarily directed.

SUMMARY OF THE INVENTION

Generally described, the present invention provides a modular lighting apparatus that includes a replaceable bulb assembly, an adapter, and a mechanical and electrical connector assembly that removably connects the bulb assembly to the adapter for use. The bulb assembly includes a light-emitting component mounted to a body. And the adapter includes a standard screw base mounted to a body that houses an electronic ballast, which is electrically connected to the screw base. When assembled with the bulb assembly and adapter bodies connected together, the ballast is electrically connected to the light-emitting component by way of the electrical connectors.

In a first example embodiment the light-emitting component includes a spiral-tube CFL. In this embodiment the lighting apparatus fits in most existing household lighting fixtures. The combination of the adapter including the screw base, the adapter including the electronic ballast, and the connector assembly enabling the bulb assembly to be replaceable on the adapter provides significant advantages over known lighting systems. In particular, a major cost of conventional CFLs is the electronic ballast, which is discarded when the bulbs burn out even though the ballasts normally have much more life left in them. With the electronic ballast being integral to the adapter, however, when the bulb assembly reaches the end of its useful life it can be removed from the adapter and replaced with a fresh bulb assembly. So the electronic ballast can be reused with new bulb assemblies, thereby saving money and avoiding waste and environmental contamination. In addition, with the adapter also including the screw base, the lighting apparatus can be used with existing standard screw-socket light fixtures without any retrofitting or replacement work. So widespread household use can be made of the lighting apparatus, thereby contributing to significant cost savings for the public as well as energy savings, reduced pollution, and less dependence on foreign energy supplies.

In a second example embodiment the light-emitting component includes a transversely arranged CFL tube. In this embodiment the lighting apparatus has the additional advantage of a very low-profile relative to other similar-wattage lighting systems, so it can be more safely used in small spaces such as closets and crawl spaces.

In a third example embodiment the light-emitting component includes an omni-directional LED array. And in a fourth example embodiment the light-emitting component includes a primary omni-directional LED array and a secondary omni-directional LED array. In these embodiments the lighting apparatus have the additional advantage of employing high-efficiency LEDs in arrangements that disperse light to illuminate a space, so they are suitable for household use to illuminate rooms.

In a fifth example embodiment the adapter mechanically and electrically connects to a commercially available replaceable CFL bulb assembly. In this embodiment the adapter provides the advantage of adapting existing screw-socket light fixtures for use with existing replaceable CFL bulb assemblies that do not include an ballast.

And in a sixth example embodiment the adapter body includes an integral photocell. In this embodiment the adapter provides the advantage of automatic on/off control without increasing the overall height of the composite lighting apparatus.

These and other features and advantages of the present invention will become more apparent upon reading the following specification in conjunction with the accompanying drawing figures.

DETAILED DESCRIPTION OF EXAMPLE EMBODIMENTS

Figure 1:
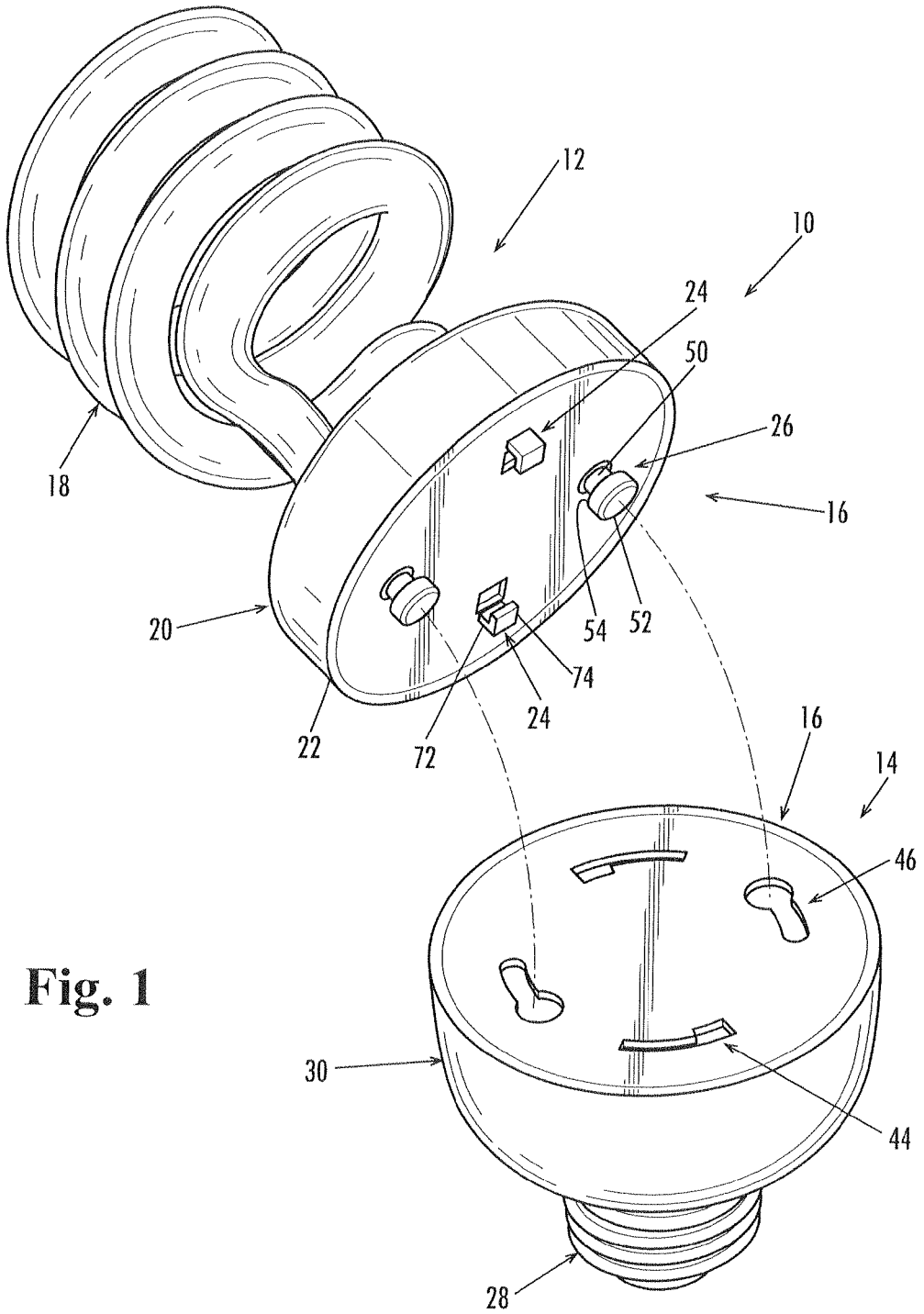
FIG. 1 is a perspective view of a modular lighting apparatus according to a first example embodiment of the present invention, showing a replaceable CFL bulb assembly separated from a screw-base adapter with an electronic ballast.
Figure 2:
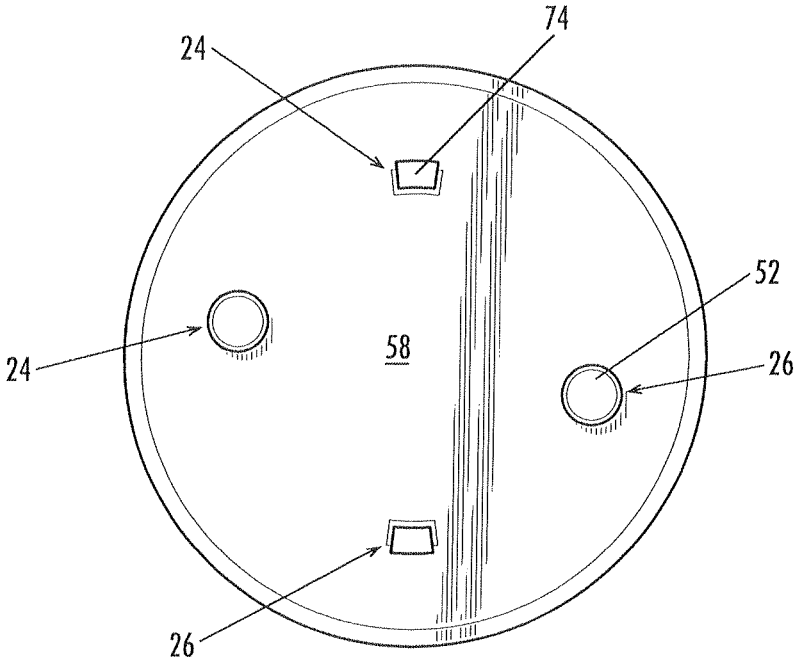
FIG. 2 is a bottom view of the bulb assembly of FIG. 1.
Figure 3:
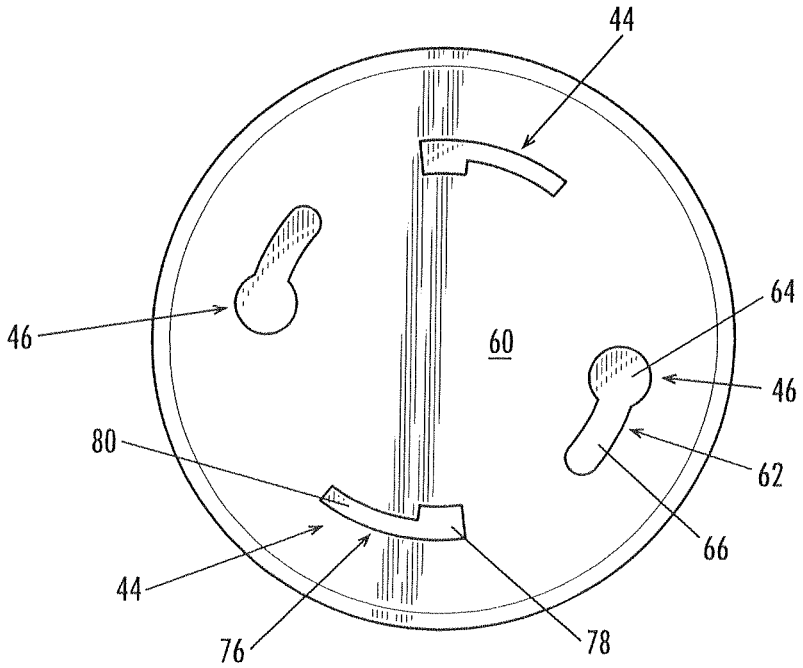
FIG. 3 is a top view of the adapter of FIG. 1.
Figure 4:
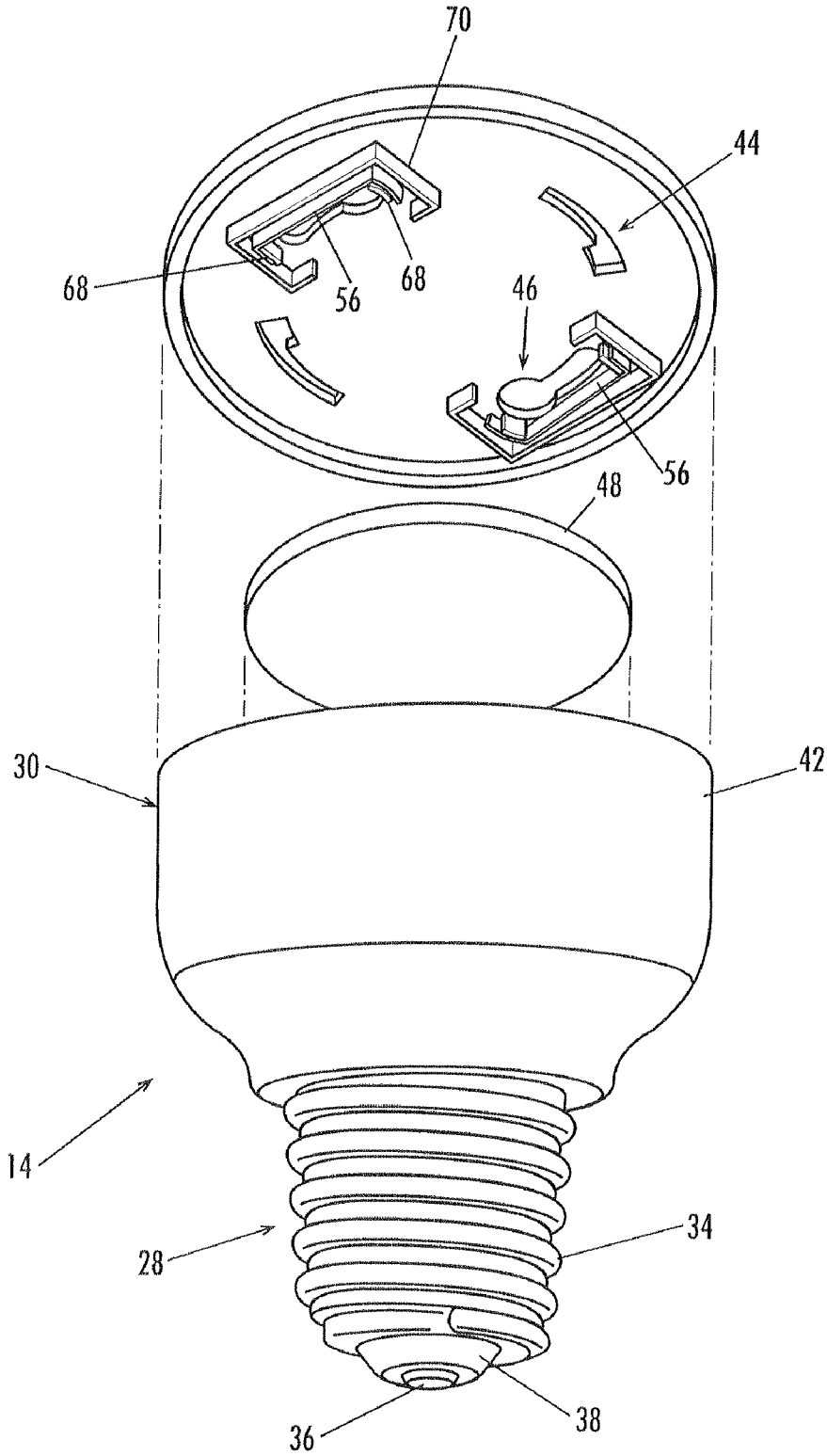
FIG. 4 is an exploded perspective view of the adapter of FIG. 1, showing the electronic ballast and electrical contacts on the inner surface of the adapter top.
Figure 5:
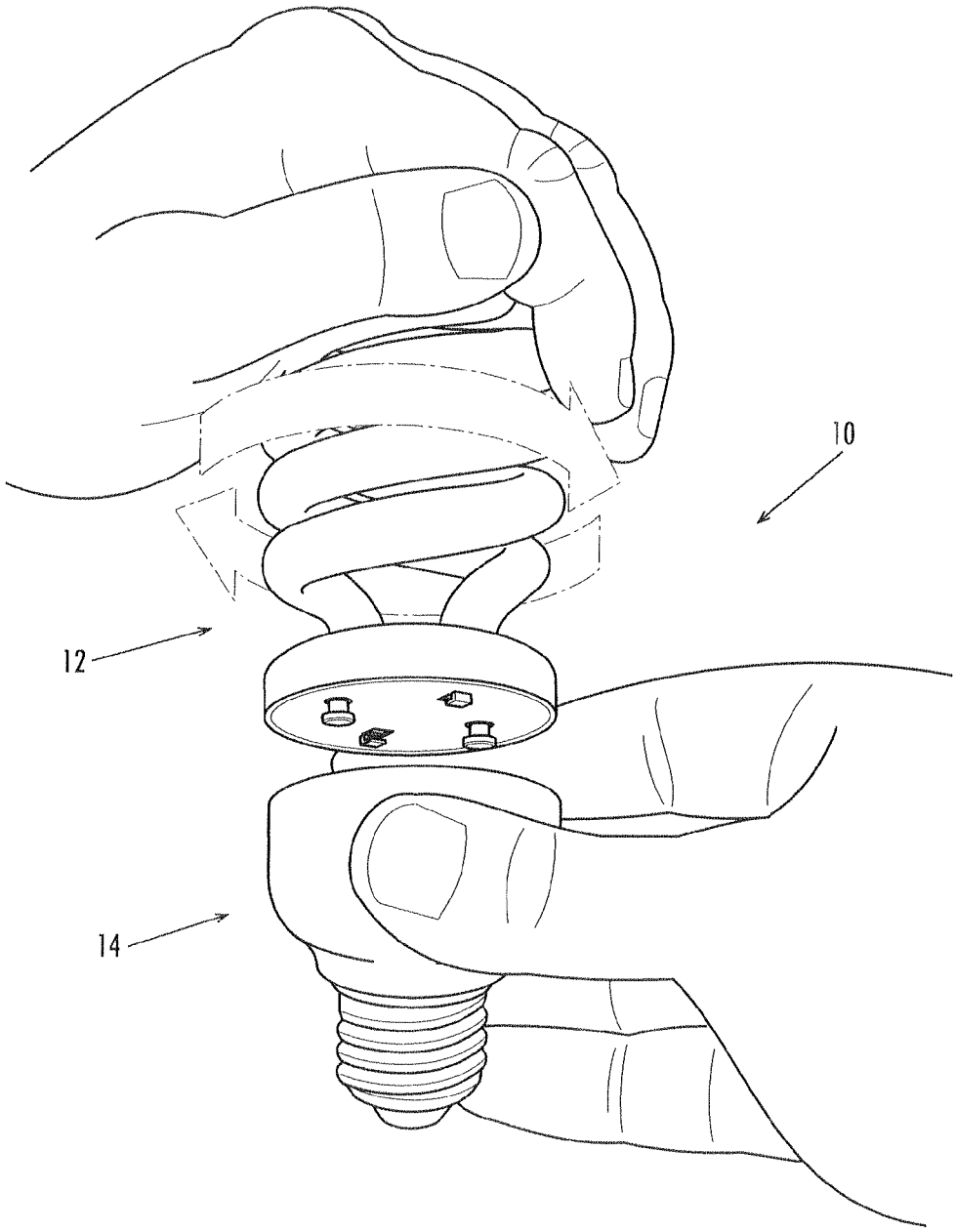
FIG. 5 is a perspective view of the modular lighting apparatus of FIG. 1, showing a new bulb being installed onto the adapter for use.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring to the drawing figures, FIGS. 1-5 show a modular lighting apparatus 10 according to a first example embodiment of the present invention. The lighting apparatus 10 includes a bulb assembly 12, an adapter 14, and a connector assembly 16. The connector assembly 16 functions to permit the bulb assembly 12 to be mechanically and electrically connected to the adapter 14 for use and, when the bulb assembly is not functioning (e.g., from being spent or damaged), to be removed and replaced with a new one.

The bulb assembly 12 includes a light-emitting component 18 and a body 20. The light-emitting component 18 may be provided by one or more compact fluorescent lamp (CFL) tubes or bulbs, other gas-discharge lamp tubes or bulbs (e.g., using neon, argon, krypton, xenon, or other noble gases), light-emitting diodes (LEDs), or other illumination devices that operate in conjunction with an electronic ballast to emit visible light. In the depicted embodiment, for example, the light-emitting component 18 is of the type included in conventional spiral-tube CFLs such as those commercially available from SYLVANIA (Danvers, Mass.) and N:VISION (Aurora, Ohio). As such, the depicted light-emitting component 18 includes a sealed glass tube containing two electrodes, a small amount of mercury, an inert gas (e.g., argon) under low pressure, and a phosphor powder coated along the inside of the tube (the components within the tube are not shown). It should be noted that the term "bulb assembly" as used herein is not limited to bulb-shaped structures.

The light-emitting component 18 is mounted to the body 20 of the bulb assembly 12. The body 20 includes a shell 22, first mechanical and electrical connectors 24 and 26 of the connector assembly 16, and electrical connections (not shown) from the electrical connectors to the electrodes of the light-emitting component 18. The shell 22 is made of a hard plastic or other durable, low-cost material that houses the electrical connections, which are of a conventional type (e.g., wiring).

The adapter 14 includes a screw base 28 and a body 30. The screw base 22 is of a conventional male type for screwing into conventional female-type screw sockets of household light fixtures. Thus, the screw base 28 includes a threaded sleeve contact 34 (also referred to as a "cap"), an end contact 36, and an insulation section 38 between the contacts (see FIG. 4). In a typical commercial embodiment, for example, the screw base 28 is a standard E26 size (according to the Edison fitting system), though other Edison screw-base sizes such as E10, E12, E14, E17, and E27 may be used.

The screw base 28 is mounted to the body 30 of the adapter 14. The body 30 includes a shell 42, second mechanical and electrical connectors 44 and 46 of the connector assembly 16, an electronic ballast 48, and electrical connections (not shown) from the screw-base contacts 34 and 36 to the electronic ballast to the electrical connectors. The shell 42 is made of a hard plastic or other durable, low-cost material that houses the electronic ballast 48 and the electrical connections, which are of a conventional type (e.g., wiring).

The electronic ballast 48 includes a control circuit of a conventional type. In a typical commercial embodiment, for example, the electronic ballast circuit is of the type included in conventional spiral-tube CFLs such as those commercially available from SYLVANIA (Danvers, Mass.) and N:VISION (Aurora, Oh.). In other embodiments, the electronic ballast circuit is of the type disclosed by U.S. Pat. Nos. 7,332,873; 6,911,788; 6,891,339; 6,879,117; 5,341,068; or 4,748,380, all of which are hereby incorporated herein by reference. It will be understood that for convenience the electronic ballast 48 is shown in a block diagram form, which is not a true likeness of this component.

The combination of the adapter 14 including the screw base 28, the adapter 14 including the electronic ballast 48, and the connector assembly 16 enabling the bulb assembly 12 to be replaceable on the adapter provides significant advantages over known lighting systems. In particular, a major cost of conventional CFLs is the electronic ballast, which is discarded when the bulb burns out even though the ballast normally has much more life left in it. With the electronic ballast 48 of the lighting apparatus 10 being integral to the adapter 14, however, when the bulb assembly 16 reaches the end of its useful life it can be removed from the adapter 14 and replaced with a fresh bulb assembly. So the electronic ballast 48 can be reused with a number of new bulb assemblies 16 over time, thereby saving a significant amount of money and avoiding unnecessarily contaminating the environment. In addition, with the adapter 14 also including the screw base 28, the lighting apparatus 10 can be used with existing standard screw-socket light fixtures without any retrofitting or replacement work. So widespread household use can be made of the lighting apparatus 10, which could contribute to a significant cost savings for the public as well as energy savings, reduced pollution, and less dependence on foreign energy supplies.

Furthermore, to aid in starting up quickly, the lighting apparatus 10 may be of an instant-start design, a rapid-start design, or a starter-switch design, all of which are well known in the art and can be readily incorporated by persons of ordinary skill in the art. In addition, the lighting apparatus 10 may include other control components known in the art and readily incorporated by persons of ordinary skill in the art. Preferably, all of these electronic components are housed in the body 30 of the adapter 14 so they can be reused with the electronic ballast 28.

Details of example connector assemblies 16 will now be described. As mentioned above, the connector assembly 16 includes first mechanical and electrical connectors 24 and 26 of the bulb assembly body 20 and second mechanical and electrical connectors 44 and 46 of the adapter body 30. The first and second electrical connectors 26 and 46 disengageably contact each other to provide a path of electrical continuity for current to flow from the adapter 14 to the bulb assembly 12. And the first and second mechanical connectors 24 and 44 disengageably couple together to securely fasten the bulb assembly 12 to the adapter 14 for use.

For example, the depicted embodiment has two first electrical connectors 26 each including a conductive pin 50 with a head 52 defining a contact 54, and two second electrical connectors 46 each including a contact 56. The shell 22 of the bulb assembly body 20 includes a mating panel 58 from which the conductive pins 50 extend, and the shell 42 of the adapter body 30 includes a mating panel 60 defining apertures 62 through which the heads 52 extend so that the first contacts 54 engage the second contacts 56. The heads 52 have a larger lateral dimension than the pins 50, and the apertures 62 are curved slots each having an enlarged portion 64 that the heads can fit through and a narrowed portion 66 that the heads cannot fit through. The contacts 56 are provided by conductive pieces (e.g., copper strips) mounted between two retainers (e.g., tabs) 68 and at least partially surrounded by an insulating wall 70. The retainers 68 and the walls 70 extend inwardly from the inner surface of the adapter mating panel 60. If desired, the adapter contacts 56 may be spring-biased to impart a force to the bulb contacts 54.

In addition, the depicted embodiment has two first mechanical connectors 26 each including an arm 72 with a head 74, and two second mechanical connectors 46 each including an aperture 76. The arms 72 extend from the bulb mating panel 58 and through the aperture 76, which is defined by the adapter mating panel 60. The heads 74 have a larger lateral dimension than the arms 72, and the apertures 76 are curved slots each having an enlarged portion 78 that the heads can fit through and a narrowed portion 80 that the heads cannot fit through.

To install the bulb assembly 12 on the adapter 14, the bulb assembly is positioned adjacent the adapter until the pin-heads 52 insert through the enlarged portions 64 of the curved apertures 62 and the arm-heads 74 insert through the enlarged portions 78 of the curved apertures 76. Then the bulb assembly 12 and the adapter 14 are rotated relative to each other to move the pins 50 into the narrowed portions 66 of the curved apertures 62 and to move the arms 72 into the narrowed portions 80 of the curved apertures 76. In this position, the pin-head bulb-side contacts 54 are held in contact with the adapter-side contacts 56 and the arm-heads 74 are restrained from longitudinal movement by the adapter mating panel 60, so the bulb assembly 12 and the adapter 14 are electrically and mechanically connected together. To later remove the bulb assembly 12 from the adapter 14, these parts are rotated in the reverse direction (as shown by the directional arrows of FIG. 5) and pulled apart.

In other embodiments the mechanical and electrical connector assembly 16 can be provided with other connection components. For example, one alternative embodiment includes combined mechanical and electrical connectors such as the electrical connectors just described, as the heads and the narrowed aperture portions of these connectors provide a mechanical connection. In another alternative embodiment the first electrical connectors are pins without heads that are inserted into apertures without enlarged portions (for electrical connection but not mechanical connection). In yet another alternative embodiment the first and second connectors (electrical, mechanical, or both) are switched between the adapter and the bulb assembly (e.g., the electrical pin extends from the adapter body instead of the bulb assembly body). And in still another alternative embodiment the mechanical connectors include catch elements (e.g., detents) that releasably secure the bulb assembly and the adapter together rotationally. It will be understood that different numbers and/or conventional types of mechanical connector elements, electrical connector elements, or both can be used with good results.

Figure 6A:
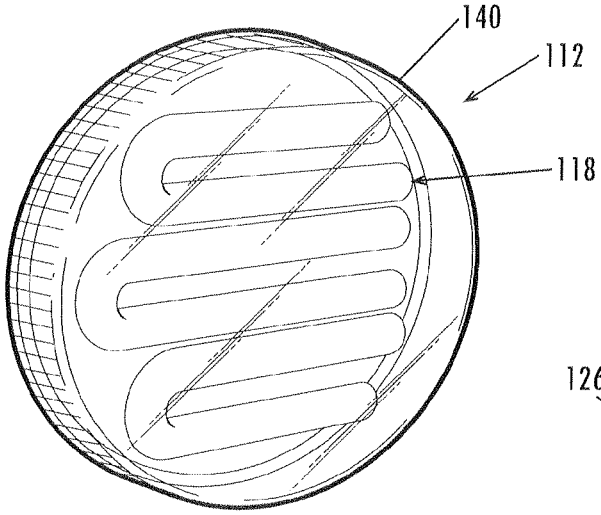
FIG. 6A is a front perspective view of a replaceable low-profile bulb assembly of a modular lighting apparatus according to a second example embodiment of the invention.
Figure 6C:
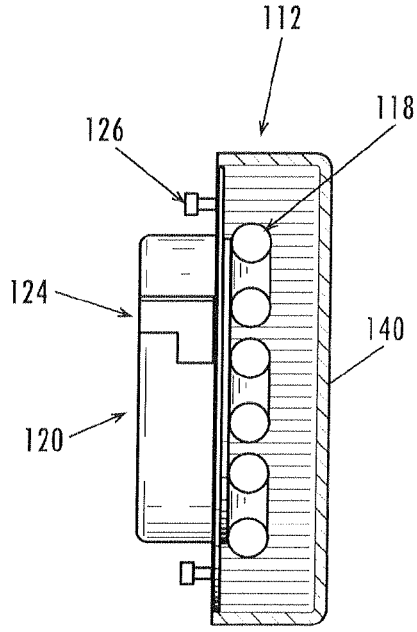
FIG. 6C is a side view, with a portion shown in cross section, of the replaceable low-profile bulb assembly of FIG. 6A.
Figure 6B:
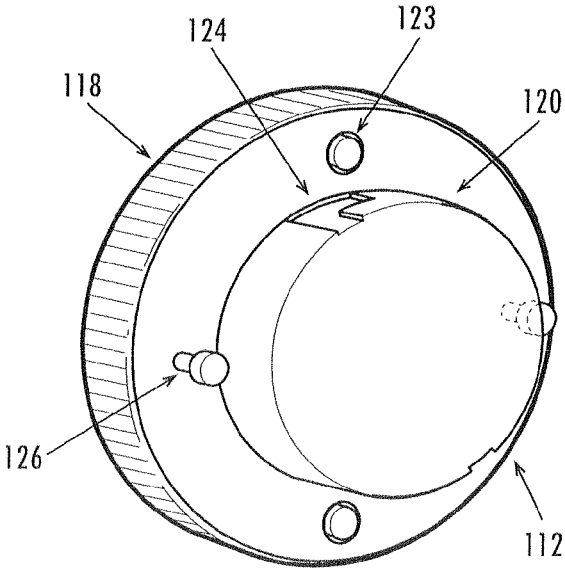
FIG. 6B is a rear perspective view of the replaceable low-profile bulb assembly of FIG. 6A.

FIGS. 6A-6C show a replaceable low-profile bulb assembly 112 of a modular lighting apparatus according to a second example embodiment of the present invention. The bulb assembly 112 is similar to that of the first example embodiment in that it includes a light-emitting component 118 attached to a body 120 having first mechanical and electrical connectors 124 and 126. In addition, the bulb assembly 112 is used with an adapter (not shown) similar to that of the first example embodiment, for example, including a screw base and a body with an electronic ballast and with second mechanical and electrical connectors that mate with the first mechanical and electrical connectors 124 and 126.

In this embodiment, however, the bulb assembly 112 has a low profile relative to that of the first embodiment. In typical commercial embodiments, this low-profile design enables the lighting apparatus to be used safely in places such as closets, crawl spaces, cabinets, dark rooms, under counters, etc. where space is limited. When using conventional lighting apparatus in these places there is the risk of bumping against the bulb, resulting in electric shock/injury to the person and/or damage to the bulb. In addition, inflammable materials are more likely to come into contact with conventional higher-profile light bulbs in tight spaces, and when the lights are left on for a prolonged period of time (and thus overheat) this can pose a fire hazard.

The low-profile light-emitting component 118 may be provided for example by one or more CFL tubes in a lateral/transverse arrangement. That is, instead of the CFL tube extending generally longitudinally away from the body (e.g., spirally as in FIG. 1 or linearly as in FIG. 9), the entire CFL tube is positioned extending laterally across and adjacent the body 120. In the depicted embodiment, for example, there are three laterally arranged CFL tubes, with the tubes being U-shaped and defining a transverse plane (see FIG. 6C) that is generally perpendicular to the longitudinal axis of the lighting apparatus. As can be seen in the figures, this design is very low profile, with the longitudinal dimension of the light-emitting component 118 being smaller (in fact, much smaller) than its transverse dimension. In other embodiments, there are more or fewer laterally arranged CFL tubes, for example, a single tube in a serpentine arrangement winding back and forth closely upon itself and defining the transverse plane. And in yet other embodiments, a reflective surface or coating is provided (e.g., on the front of the bulb assembly body or the back of the tubes) that directs the rearward-emitted light (from the tubes toward the body) forwardly in the desired direction (away from the body).

In addition, the bulb assembly 112 may include a diffuser cover 140 made of glass or another generally transparent material. The diffuser cover 140 helps provide some insulating space to keep any nearby inflammable items from directly contacting the CFL tube. The diffuser cover 140 has a small longitudinal dimension (relative to its transverse dimension) so that it too has a low profile. In the depicted embodiment, the diffuser cover 140 is generally disk-shaped with a flat outer surface. In other embodiments the cover is thin but rectangular, polygonal, etc., as may be desired in a given application.

Furthermore, the mechanical and electrical connectors can be of the same or a different type as those of the first example embodiment. In the depicted embodiment, for example, the electrical connectors are the same (e.g., a pin-and-head connector received in a slot with enlarged and narrowed portions). The mechanical connectors are similar but somewhat different. In particular, the mechanical connectors include a slotted aperture (as shown) and a tab with a head (not shown). The slotted aperture has a first portion that extends longitudinally and a second portion that extends transversely to lock the head from being withdraw longitudinally.

Additionally or alternatively, the mechanical connectors can be provided by magnetic pieces (e.g., magnet and metal pieces) positioned on (e.g., recessed into) the adapter and bulb assembly bodies so that they align and face each other. This helps to keep the adapter and bulb assembly securely connected together even if they reverse-rotate a little bit. In the depicted embodiment, for example, a magnetic mechanical connector 123 is shown on the bulb assembly body 120.

Figure 7:
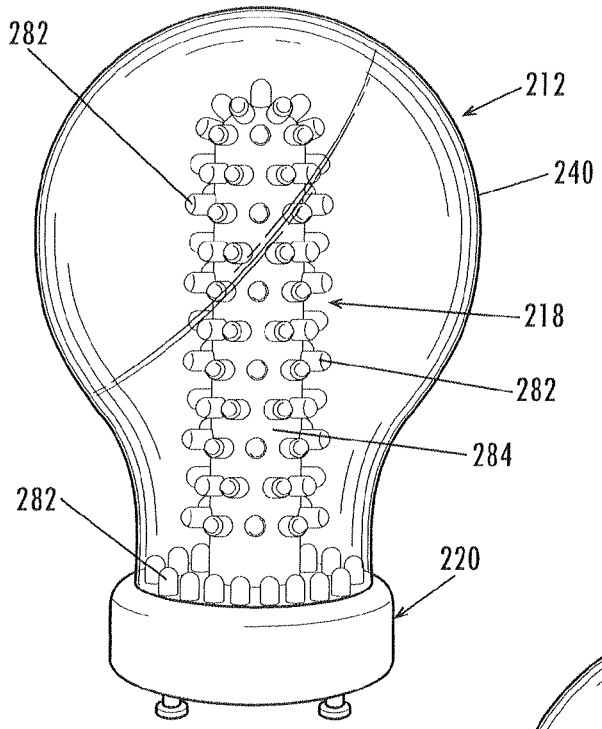
FIG. 7 is a perspective view of a replaceable LED bulb assembly of a modular lighting apparatus according to a third example embodiment of the invention.

FIG. 7 shows a replaceable LED bulb assembly 212 of a modular lighting apparatus according to a third example embodiment of the present invention. The bulb assembly 212 is similar to that of the first example embodiment in that it includes a light-emitting component 218 attached to a body 220 having first mechanical and electrical connectors. In addition, the bulb assembly 212 is used with an adapter (not shown) similar to that of the first example embodiment, for example, including a screw base and a body with an electronic ballast and with second mechanical and electrical connectors that mate with the first mechanical and electrical connectors.

In this embodiment, however, the light-emitting component 218 includes an array of LEDs 282. The number and lumen ratings of the LEDs 282 are selected based on the illumination desired. The LEDs 282 may be of a conventional type such as the residential and commercial model LR6 LEDs commercially available from CREE (Durham, N.C.). Additionally, the bulb assembly 212 may include a diffuser cover 240 made of glass or another generally transparent material. The diffuser cover 240 preferably has a screw-threaded base that mates with screw-threading on the body 220 so that it can be removed and replaced if needed. Also, the electronic ballast is of a different design and includes a ballast circuit for controlling LEDs. The selection and design of such LED electronic ballast circuits are within the abilities of those of ordinary skill in the art.

In typical LED devices, the LEDs are in a parallel arrangement so that all of the LEDs point in the same direction. In this embodiment, however, at least some (and preferably the majority) of the LEDs 282 are mounted on an upright stem 284 in an omni-directional arrangement, that is, with the LEDs pointed in many different directions. For example, in the depicted embodiment a number of the LEDs 282 extend radially outward from the stem 284 in a staggered arrangement so that no adjacent LEDs are parallel and pointed in the same direction. The upright stem 284 extends from the body 220, houses electrical connections from the LEDs 282 to the first electrical connectors, and is made of a material such as hard plastic or ceramic.

In alternative embodiments the LEDs are positioned in other omni-directional arrangements. For example, in one alternative embodiment the stem is generally spherical, hemispherical, aspherical, or hemi-aspherical, and some or all of the LEDs extend radially outward from the spherical stem so that each of these LEDs is pointed in a different direction.

Figure 8:
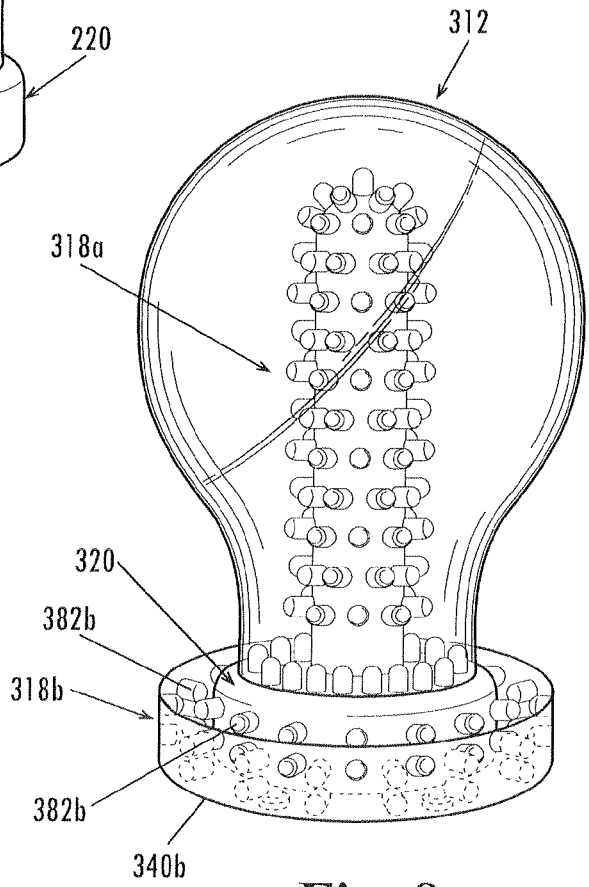
FIG. 8 is a perspective view of a replaceable LED bulb assembly of a modular lighting apparatus according to a fourth example embodiment of the invention.

FIG. 8 shows a replaceable LED bulb assembly 312 of a modular lighting apparatus according to a fourth example embodiment of the present invention. The bulb assembly 312 is similar to that of the third example embodiment just described. In particular, the replaceable LED bulb assembly 312 includes the primary LED light-emitting component 318*a* and the body 320 of LED bulb assembly 212 of the third example embodiment. However, this embodiment also includes a secondary LED light-emitting component 318*b* mounted to the body 320. In the depicted embodiment, for example, the secondary LED light-emitting component 318*b* is provided by radially inward and radially outward arranged LEDs 382*b* in an annular diffuser cover 340*b*. The diffuser cover 340*b* preferably has a screw-threaded base that mates with screw-threading on the body 320 so that it can be removed and replaced if needed.

Figure 9:
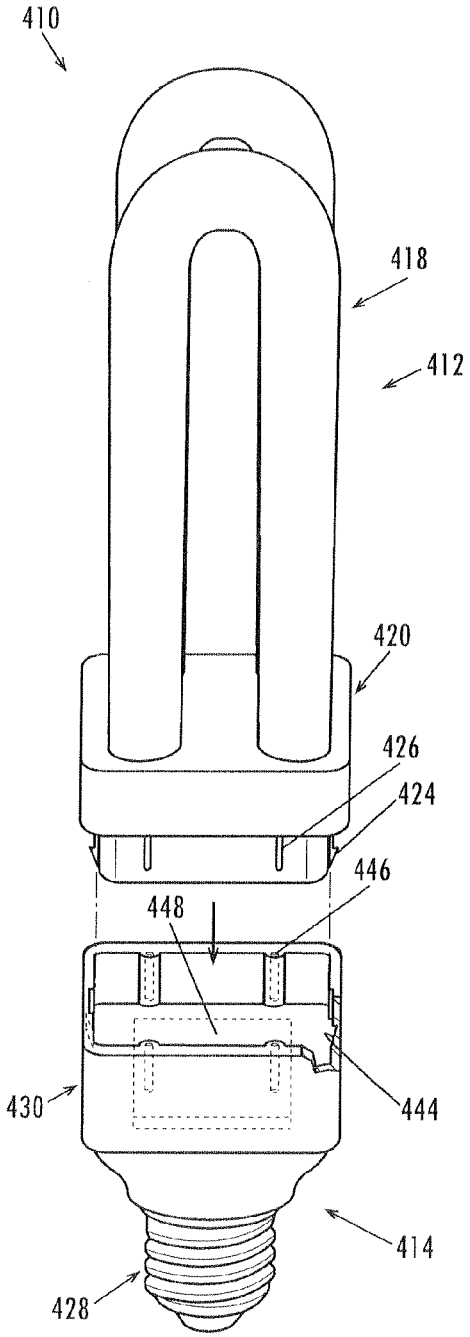
FIG. 9 is a side view of a modular lighting apparatus according to a fifth example embodiment of the invention, showing a conventional replaceable CFL bulb separated from a screw-base adapter with an electronic ballast.

FIG. 9 shows a modular lighting apparatus 410 according to a fourth example embodiment of the present invention. In this embodiment, the adapter 414 is configured for use with commercially available replaceable CFL bulb assemblies 412. For example, the CFL bulb assembly 412 may of a twin- or triple-tube type commercially available from Philips Electronics (Andover, Mass.) or General Electric (Fairfield, Conn.). Similarly to the first embodiment, the adapter 414 includes a screw base 428 attached to a body 430 having an electronic ballast 428 and mechanical and electrical connectors 444 and 446. In this embodiment, however, the adapter body 430 is sized and shaped (i.e., with a generally rectangular opening) to receive a portion of the bulb assembly body 420. The electrical connectors 446 are provided by apertures that house contacts and receive the pin electrical connectors 426 of the bulb assembly 412. And the mechanical connectors 444 are provided by notches that releasably receive the spring arm mechanical connectors 424 of the bulb assembly 412.

Figure 10:
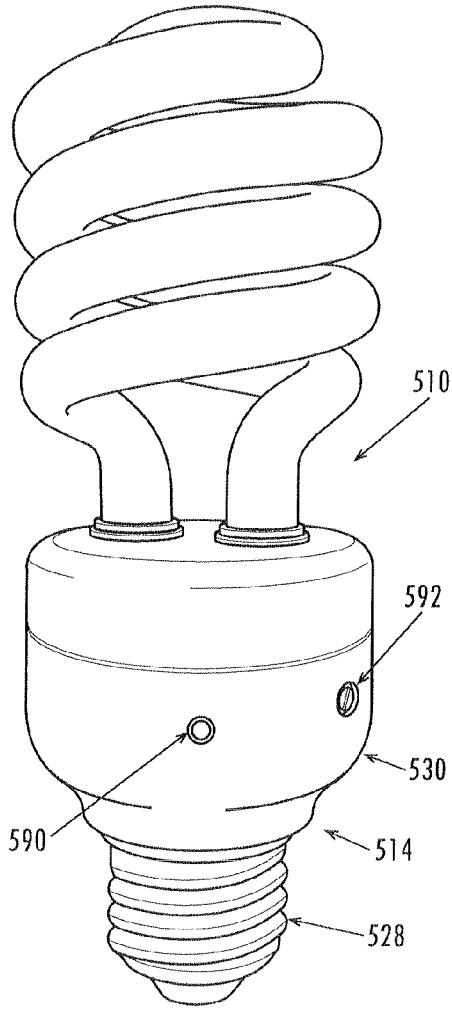
FIG. 10 is a perspective view of a modular lighting apparatus according to a sixth example embodiment of the invention, showing a replaceable bulb assembly installed onto a screw-base adapter with an electronic ballast and an integral photocell.

FIG. 10 shows a modular lighting apparatus 510 according to a fifth example embodiment of the present invention. This lighting apparatus 510 is the same as that of the first embodiment, except for the inclusion of a light-sensing control device 590. Currently available light-sensing control devices are typically provided in separate units that are installed in-line between the screw socket of the light fixture and the screw base of the light bulb. But this significantly increases the overall height of the composite light assembly, which can be problematic for lighting fixtures with limited space (e.g., enclosed outdoor lanterns). Typical units with light-sensing control devices add one or two or more inches to the overall height of the composite light assembly, with the result that they oftentimes cannot be used due to space limitations. In this embodiment, however, the adapter 514 of the lighting apparatus 510 includes an integral light-sensing control device 590.

In typical commercial embodiments, the light-sensing control 590 is a photocell of the type commercially available from AMERTAC (Saddle River, N.J.) under the WESTEK brand or from LAMSON HOME PRODUCTS (Cleveland, Ohio) under the CARLON brand. As such, the photocell functions to vary the current flow based on the amount of light incident to it, with its resistance increasing in high-light conditions and decreasing in low-light conditions. In addition, the adapter 514 may include an integral sensitivity control 592 of a type known in the art. With the light-sensing control 590 arranged as an integral part of the adapter 514 without increasing the height of the adapter, the overall height of the composite light fixture remains the same while providing the added feature of light control (on at dusk and off at dawn). It should be noted that the light-sensing control device can be integrally provided in any of the embodiments described herein as well as others not expressly disclosed herein.

While the invention has been shown and described in preferred forms, it will be apparent to those skilled in the art that many modifications, additions, and deletions can be made therein. These and other changes can be made without departing from the spirit and scope of the invention as set forth in the following claims.

What is claimed is:

1. A modular lighting apparatus for use with a screw-socket light fixture, the lighting apparatus comprising:

a bulb assembly including a body and a light-emitting component mounted to the body;

an adapter including a body, a screw base mounted to the body and receivable in the screw-socket light fixture, and an electronic ballast housed in the body and electrically connected to the screw base; and a mechanical and electrical connector assembly that removably connects the bulb assembly to the adapter for use, wherein the bulb assembly is replaceable and the electronic ballast is reusable and the light-emitting component includes an omni-directional LED array.

2. The lighting apparatus of claim 1, wherein the light-emitting component includes a spiral-tube CFL.

3. The lighting apparatus of claim 1, wherein the light-emitting component includes a CFL tube in transverse arrangement with a low profile.

4. The lighting apparatus of claim 3, wherein the CFL has a transverse dimension and a longitudinal dimension that is less than the transverse dimension.

5. The lighting apparatus of claim 1, further comprising a light-sensing control device that is integral to the adapter body.

6. The lighting apparatus of claim 1, wherein the light-emitting component includes an upright stem and at least a portion of the LED array is arranged in an omni-directional fashion on the stem.

7. The lighting apparatus of claim 6, wherein the LED array includes LED's radially arranged on the stem in a staggered fashion so that no adjacent LED's are parallel and pointed in the same direction.

8. The lighting apparatus of claim 1, wherein the light-emitting component includes a first LED array arranged in an omni-directional fashion on an upright stem and a second LED array arranged in an omni-directional fashion annularly around the bulb assembly body.

9. The lighting apparatus of claim 1, wherein the light-emitting component includes a conventional linear-tube CFL.

10. The lighting apparatus of claim 1, wherein the screw base includes a sleeve contact, an end contact, and an insulation section therebetween.

11. The lighting apparatus of claim 1, wherein the connector assembly includes first mechanical and electrical connectors of the bulb assembly body and second mechanical and electrical connectors of the adapter body, wherein the first and second electrical connectors disengageably contact each other to provide a path of electrical continuity for current to flow from the adapter to the bulb assembly, and wherein the first and second mechanical connectors disengageably couple together to securely fasten the bulb assembly to the adapter for use.

12. The lighting apparatus of claim 11, wherein the first electrical connectors each include a conductive pin with a head defining a contact, the second electrical connectors each include a contact positioned within the adapter body, and the adapter body defines at least one aperture for each of the second electrical connectors through which the heads extend so that the first contacts engage the second contact.

13. The lighting apparatus of claim 12, wherein the heads each have a larger lateral dimension than the pins, and the apertures are curved slots each having an enlarged portion that the heads can fit through and a narrowed portion that the heads cannot fit through, wherein the bulb assembly and the adapter electrically connect together upon rotation of the bulb assembly relative to the adapter.

14. The lighting apparatus of claim 11, wherein the first mechanical connectors each include an arm with a head, the second mechanical connectors each include an aperture, the arms extend from the bulb assembly body and through the apertures, the heads have a larger lateral dimension than the arms, and the apertures are curved slots each having an enlarged portion that the heads can fit through and a narrowed portion that the heads cannot fit through, wherein the bulb assembly and the adapter mechanically connect together upon rotation of the bulb assembly relative to the adapter.

15. The lighting apparatus of claim 1, wherein the mechanical connectors and the electrical connectors are separate structures.

16. A modular lighting apparatus for use with a screw-socket light fixture, the lighting apparatus comprising:

a bulb assembly including a body and a CFL tube mounted to the body;

an adapter including a body, a screw base mounted to the body and receivable in the screw-socket light fixture, and an electronic ballast housed in the body and electrically connected to the screw base, wherein the screw base includes a sleeve contact, an end contact, and an insulation section therebetween;

a mechanical and electrical connector assembly that removably connects the bulb assembly to the adapter for use, wherein the bulb assembly is replaceable and the electronic ballast is reusable, wherein the mechanical connectors are provided by first and second magnetic pieces with the first magnetic piece positioned on the adapter body and the second magnetic piece positioned on the bulb assembly body aligned with and facing the first magnetic piece when the bulb assembly is connected to the adapter body.

17. The lighting apparatus of claim 16, further comprising a photocell that is integral to the adapter body.

18. The lighting apparatus of claim 16, wherein the CFL tube is selected from the group consisting of i a spiral-tube CFL, ii a low-profile CFL tube in transverse arrangement, and iii a conventional linear-tube CFL.

19. The lighting apparatus of claim 16, wherein the connector assembly includes first mechanical and electrical connectors of the bulb assembly body and second mechanical and electrical connectors of the adapter body, wherein the first and second electrical connectors disengageably contact each other to provide a path of electrical continuity for current to flow from the adapter to the bulb assembly, and wherein the first and second mechanical connectors disengageably couple together to securely fasten the bulb assembly to the adapter for use.

* * * * *